US006811422B1

(12) United States Patent
Muller

(10) Patent No.: US 6,811,422 B1
(45) Date of Patent: Nov. 2, 2004

(54) ELECTRICAL CONNECTOR WITH PRESSURE SPRING AND LEVER

(75) Inventor: Klaus Muller, Oberscheinfeld (DE)

(73) Assignee: FCI, Paris (FR)

( * ) Notice: Subject to any disclaimer, the term of this patent is extended or adjusted under 35 U.S.C. 154(b) by 0 days.

(21) Appl. No.: 09/574,277

(22) Filed: May 19, 2000

(30) Foreign Application Priority Data

May 21, 1999 (DE) ..... 199 23 386

(51) Int. Cl.[7] ..... H01R 4/54
(52) U.S. Cl. ..... 439/314; 439/255; 439/352
(58) Field of Search ..... 439/314, 253, 439/258, 259, 157, 319, 261, 255, 352

(56) References Cited

U.S. PATENT DOCUMENTS

| | | | | | |
|---|---|---|---|---|---|
| 3,173,473 | A | * | 3/1965 | Loveland | 431/80 |
| 4,279,458 | A | * | 7/1981 | Knapp | 439/255 |
| 4,477,022 | A | * | 10/1984 | Shuey et al. | 439/590 |
| 5,620,019 | A | * | 4/1997 | Nicolaisen | 137/315 |
| 5,647,776 | A | * | 7/1997 | Duclos et al. | 439/752 |
| 5,662,488 | A | | 9/1997 | Alden | 439/314 |
| 5,662,628 | A | * | 9/1997 | Hollands | 604/342 |
| 5,820,409 | A | * | 10/1998 | Clark et al. | 439/595 |
| 5,823,808 | A | * | 10/1998 | Clark et al. | 439/157 |
| 5,957,716 | A | * | 9/1999 | Buckley et al. | 439/321 |

FOREIGN PATENT DOCUMENTS

| | | |
|---|---|---|
| DE | 1415667 | 10/1968 |
| DE | 1665644 | 3/1971 |
| DE | 2951455 | 7/1980 |
| DE | 32 48 154 C1 | 4/1984 |
| EP | 0 512 323 A1 | 11/1992 |

* cited by examiner

*Primary Examiner*—P. Austin Bradley
*Assistant Examiner*—James R. Harvey
(74) *Attorney, Agent, or Firm*—Perman & Green, LLP

(57) ABSTRACT

Described is an electrical plug connector with a cylindrical plug (20), a counterplug (1) which is complementary to plug (20), a bayonet ring (23) which is rotatable about the housing (3) of the counterplug (1) for locking the plug connector (20) into the counterplug, where the bayonet ring (2) can be pushed in the direction of plug insertion for the locking of the plug (20) on the housing (23) of the plug, until at least one locking device of the bayonet ring (2) has interlocked with the plug housing (23) and the bayonet ring (2) can be rotated about the counterplug housing (3) for the purpose of unlocking the plug connector.

6 Claims, 4 Drawing Sheets

ELECTRICAL CONNECTOR WITH PRESSURE SPRING AND LEVER

FIELD OF THE INVENTION

The invention concerns an electrical plug connector, in particular for automotive applications with a cylindrical plug, a counterplug which is complementary thereto and a bayonet ring which is rotatable about the housing of the counterplug for the locking of the plug into the counterplug Such plug connectors are preferably located in the wall of a housing in order to link the electrical connectors of a device located within the housing with outside current conductors. For example, such plug connectors are used as gearbox pre-cabling.

BACKGROUND OF THE INVENTION

Especially in the area of motor vehicle gearboxes there occur, apart from relatively high operating temperatures, strong vibrations that may lead to the loosening of the plug connector.

In order to make the plug connector safe from becoming loosened, existing plug connectors have control systems which are intended to lock the plug into the counterplug. For example, such plugs have a bayonet ring as a locking device. Care must be taken during fitting to ensure that the locking device really is locked into place. It can however happen in practice that during the process of plug insertion such a rotation movement of the bayonet ring is undesirable. In this way, the plugs can be arranged in difficult to reach narrow areas of a gearbox housing where whilst the rotating movement is possible it is time-consuming because the bayonet ring is, for example, difficult to grip.

The task of the invention is that of creating an electrical plug which is simple to assemble and dismantle, even in areas, which are accessible with difficulty.

This task is accomplished by means of the characteristics of patent claim 1.

SUMMARY OF THE INVENTION

The electrical plug connector according to the invention comprises a cylindrical plug, a counterplug which is complementary thereto and a bayonet ring which can be rotated about the counterplug housing for the purpose of locking the plug into the counterplug. In order to lock off the plug connector, the bayonet ring can be pushed on the housing of the plug in the direction of insertion, until at least one locking device of the bayonet ring has interlocked with the plug housing. Further, in order to unlock the plug connector, the bayonet ring can be rotatable about the counterplug housing.

The combined action, according to the invention of the bayonet ring and the plug brings it about that the bayonet ring can simply be pushed in the direction of plug insertion. This means that in order to lock the plug into the counterplug, the bayonet ring is not rotated but pushed along the axis of the plug housing on the latter. The plug connector is loosened by means of rotating the bayonet ring.

The invention offers the advantage that the plugs can be locked rapidly and reliably. The fitter only needs to press the counterplug on the plug, The fitting of such plug connectors takes place more frequently than their dismantling, since these plug connectors are only loosened when, for example, the gearboxes are serviced. In this way, in vehicle mass production, the fitting of such plug connectors is made more rapid without losing the advantages of a bayonet closure that is important in moving belt production. In contrast, a vehicle mechanic can spend the necessary time in carrying out repair work on a vehicle, making the time needed for the rotation of the bayonet ring in order to loosen the plug connector non-critical.

Further advantageous developments of the invention are characterised in the subsidiary Claims.

An advantageous embodiment of the invention is that the locking device comprises at least one spring tongue with an inward-directed peg moulded onto the bayonet ring and running in the direction of plug insertion and that the circumference of the plug housing has at least one sliding channel which is suitable for receiving the peg. The start area of the sliding channel runs substantially at an angle to the direction of plug insertion. The terminal area of the sliding channel runs substantially parallel to the direction of plug insertion where the terminal area has at least one locking lug which can be negotiated by the peg, where both areas run into the front face of the plug housing. These further developments offer the advantage that the peg of the spring tongue and the locking lug of the terminal area achieve the locking of the plug connector. The sliding channel which runs parallel to the direction of plug insertion makes it possible for the bayonet ring to be pushed in the direction of plug insertion. On the bayonet ring being rotated, the start area of the sliding channel which runs at an angle forms a step-down, so that the dismantling of the plug connector is made easier.

A further advantageous embodiment of the invention is that the bayonet ring has at least one outward-pointing pin. Apart from this, the plug housing may have at least one lever arm, which can be rotated vertically to the direction of plug insertion in order to grip the pin. On actuating the lever arm, the required force of insertion is reduced.

A further advantageous embodiment of the invention is the fact that the bayonet ring has two diametrically opposite pins. The plug housing may have two diametrically opposite L-shaped lever arms that are connected by essentially semi-cylindrical C-straps. When the C-strap is actuated, both the L-shaped lever arms grip the outward-pointing pins. In a locked state, the C-hoop and its two L-shaped lever arms form an additional rotation lock.

Yet another advantageous embodiment of the invention consists in the fact that about the plug housing between a stop element and the direction of plug insertion a collar is arranged which can be pushed forwards or backwards. This makes it possible for the collar to shield the plug housing from possible soiling.

A further advantageous embodiment of the invention is that a pressure spring pushes against a first stop of the collar and against a second stop of a circlip so that in the event of incomplete insertion of the bayonet ring the latter will be pushed back through the front face of the collar. This offers the advantage that the fitter will immediately see when the bayonet ring is in the locking position so that if this locking position is not reached, the bayonet ring will automatically be pushed back through the collar.

A further advantageous embodiment of the invention is that following the complete insertion of the bayonet ring, the collar rests on the spring tongues. In this way, the collar acts as a secondary lock, since the spring tongues including pegs cannot come out of their locked position without hitting against the collar.

An embodiment example of the invention is represented in the schematic diagram and will be described in greater detail below, as further particularities and advantages of the invention obtained.

BRIEF DESCRIPTION OF THE DRAWINGS

The following is shown by the figures:

DETAILED DESCRIPTION OF THE INVENTION

Figure 2:
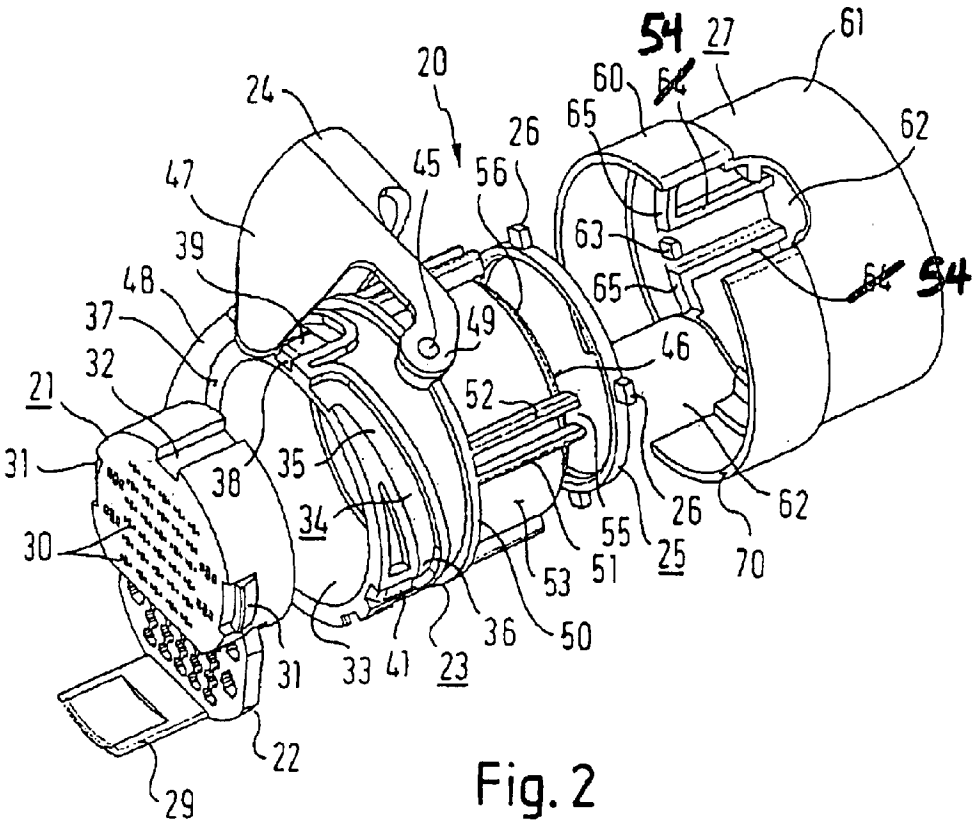
Figure 1:
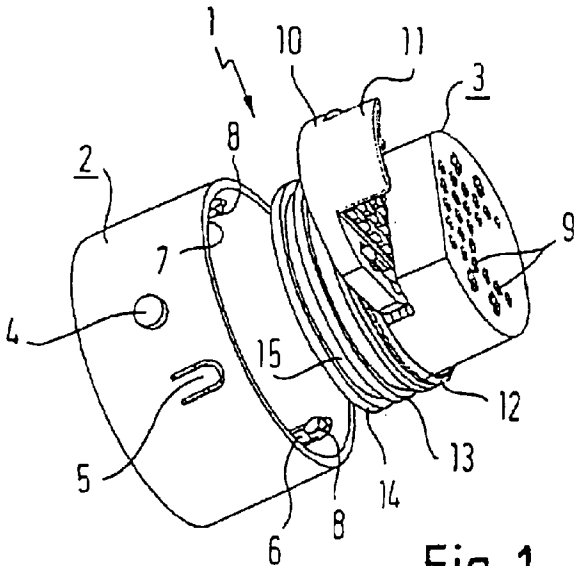
Figure 3A:
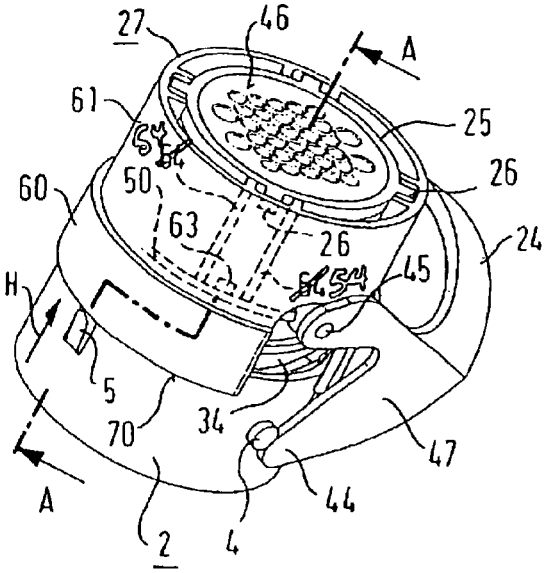
Figure 4:
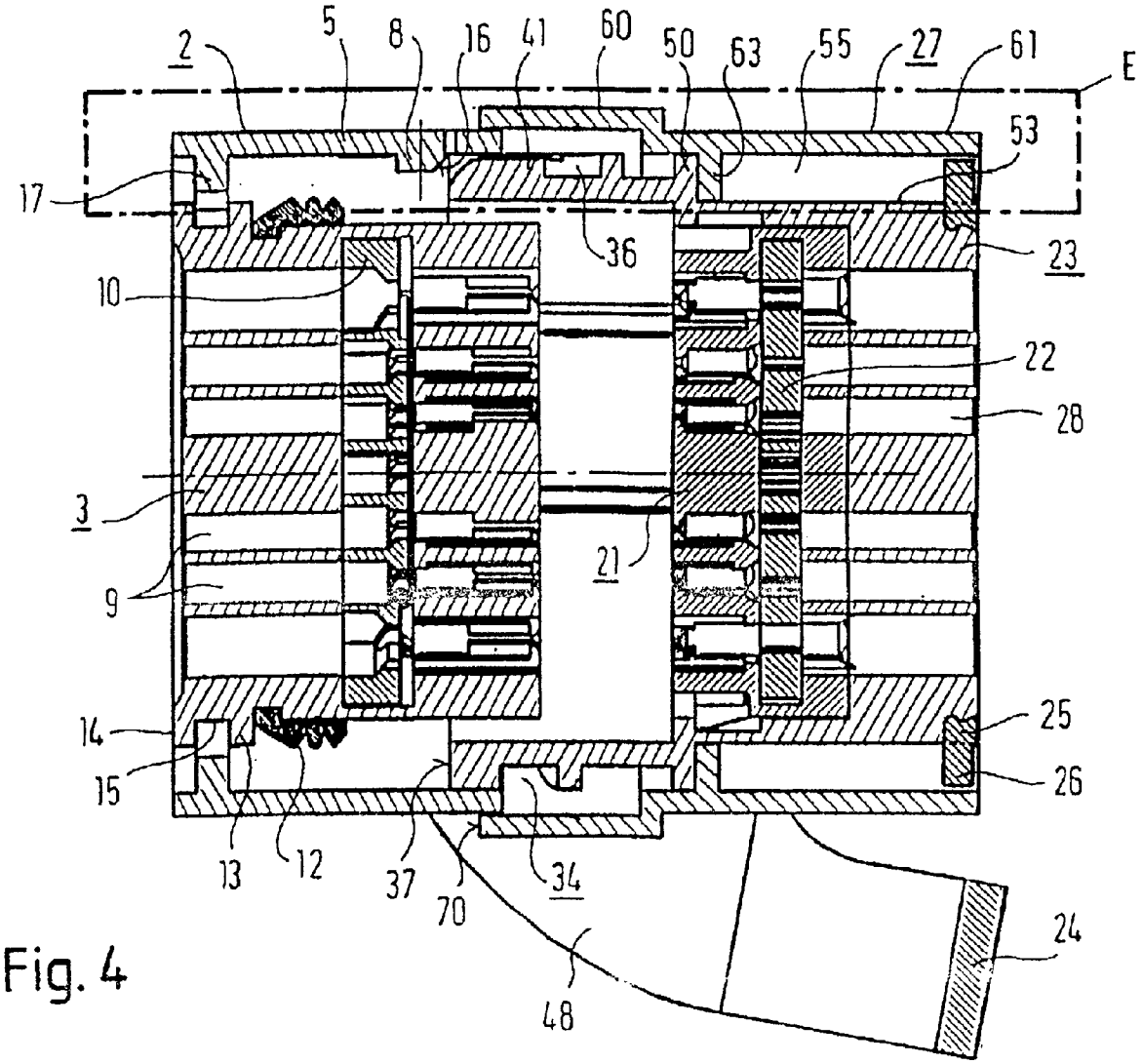

FIG. 1 a perspective view of a counterplug according to the invention, including bayonet ring;

FIG. 2 an exploded view of the plug according to the invention;

FIGS. 3*a*–3*d*, a perspective view of the plug according to the invention with the plug from FIG. 2 and the counterplug from FIG. 1 in various positions;

FIG. 4 is a schematic section along line A from FIG. 3*a;*

FIGS. 5*a*–5*d* a part-enlargement of area E of FIG. 4 in various positions.

FIG. 1 shows an exploded view of a counterplug 1 with a bayonet ring 2 and a counterplug housing 3. The cylinder-shaped bayonet ring 2 has on its outer circumference two outward-pointing pins 4 and three spring tongues 5, 6 and 7 each with an inward-pointing peg 8. The counterplug housing 3 has, along the direction of plug insertion, electrical contact chambers 9 which can be locked with the coding 11 by means of a cross slide 10. The counterplug housing 3 which is also cylindrical has on its circumference behind the cross slide 11 a profiled gasket ring 12 resting on a first guide rail 13 which runs over the entire circumference of the counterplug housing 3. Together with a second guide rail 14 which also runs over the entire circumference of the counterplug housing, it encloses a rotation guide channel 15 to receive the bayonet ring 2.

FIG. 2 shows an exploded view of a plug 20 according to the invention which fits into the counterplug 1. From left to right are shown an insert 21 with a cross slide 22 which also has a coding 29, a plug housing 23 with a swivelable strap 24, a circlip 25 with four outward-pointing second stop elements 26 and a substantively cylindrical collar 27. The insert 21 also chambers 30 which also run in the direction of plug insertion for the reception of electrical contacts, two outward-pointing diametrically opposite locking arms 31 on its circumference and a guide channel 32 also on its circumference, which runs in the direction of plug insertion. The insert 21 can be arranged in the front opening 33 of the plug housing 23.

The substantively cylindrical plug housing 23 has three sliding channels 34, each of whose start area 35 runs at an angle to the direction of plug insertion and whose terminal area 36 runs parallel to the direction of plug insertion. Both areas 35 and 36 run into the front face 37. A locking lug 41 which is enclosed by a ramp 39 and a plane 40 which runs parallel and vertically to the direction of insertion, is moulded on in the terminal area 36 of the sliding channel 34 in the vicinity of the front face 37 (cf FIG. 4/FIG. 5). On the circumference of the plug housing 23 there are two diametrically opposite, outward-pointing studs 45 which are located at approximately the same distance from the front face 37 and the rear face 46. The C-shaped substantively semicylindrical strap 24 links two substantively L-shaped lever arms 47 and 48 whose one end 49 are arranged to swivel about the stud 45. On the level of the stud 45 along the circumference of the plug housing 23 is a moulded-on outward-pointing rail 50. From this rail 50 run parallel to the direction of insertion two side walls 51 and 52, which terminate in the vicinity of the rear face 45 and enclose a spring chamber 55.

Altogether there are provided, arranged on the circumference of the plug housing 23 and offset by 90° four such spring chambers 55 including sidewalls 51 and 52. A channel 56 to receive the circlip 25 is incorporated in the rear face 46.

The front part 60 of the substantively cylindrical collar 27 has a bigger radius than in its rear Part 61. Diametrically opposite one another and running in the direction of plug insertion and into the front area are provided two recesses 62 for the strap 24. Inside the rear part 61 are located to fit into the spring chambers 55, a first stop 63 and parallel to the direction of plug insertion two guide walls 54 whose distance apart is so chosen that the side wall 51 and 52 can slide in between. Further, on the level of the first stop 63 an inward-pointing partly interrupted sliding shoulder 65 is moulded on, whose inside radius is so chosen that the sliding shoulder can be led to the shell surface 53 of the plug housing 23 between the side walls 51 and 52.

To build up the plug connector, the chambers 9 and 30 are first fitted with electrical contacts and then locked by the corresponding cross-slides 10 or 22. In the case of the counterplug 1, the next step is that of drawing the bayonet ring over the housing 3, so that the shoulders 17 of the bayonet ring 2 which are not shown in FIG. 1 reach the guide channel 15. In the case of the plug 20, the insert 21 is introduced into the opening 33 of the plug housing 23 until the locking arms 31 are locked in there. As the next step, the collar 27 is pushed on the plug housing 23 in such a way that the stop 63 arrives between the corresponding sidewalls 51 and 52 until it strikes against the rail 50. Thereafter, each of the four spring chambers 55 is fitted with a pressure spring, which is not shown. The circlip 25 is then introduced into the channel 56, so that the second stops 26 are arranged between the side walls 51 and 52, reach the pressure spring 66 and close the spring chamber 55.

Following the assembly of the plug and the counterplug, they can be inserted into one another as explained below.

FIGS. 3*a* to 3*d* show in perspective a plug connector in various positions with the counterplug 1 from FIG. 1 and the plug 20 from FIG. 2.

Figure 3B:
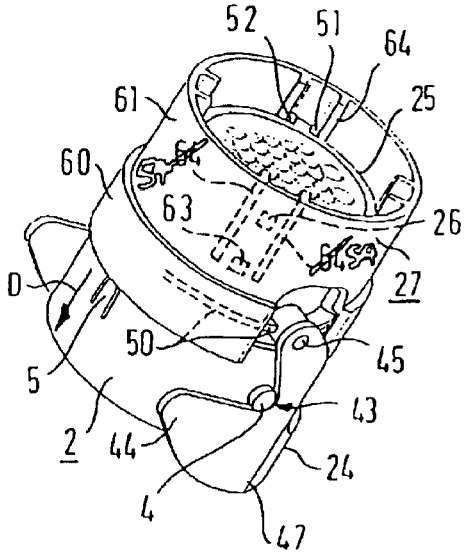
Figure 3C:
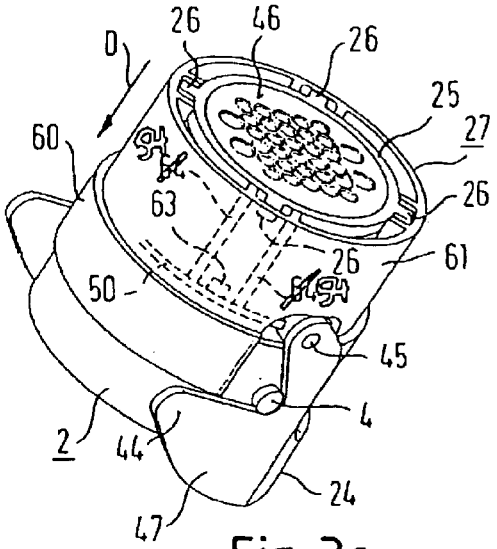
Figure 3D:
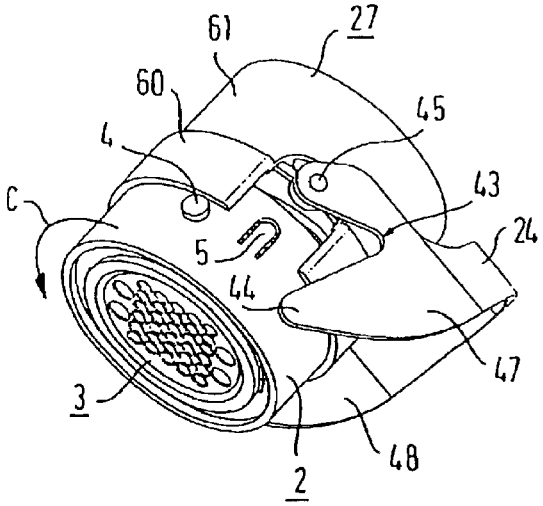

FIG. 3*a* shows the plug connector according to the invention at the initial stage of the insertion process. When the lever is swivelled downwards, the free end 44 of the lever 47 reaches the pin 4. As will also be explained below, the spring tongues 5–7 are lifted so that their free ends 19 reach the front face 70 of the collar. If the strap 24 is swivelled further towards the plug connector, the free end 44 of the lever 47 grips the pin 4 so that the bayonet ring 2 is pushed over the plug housing 23 and the outward-protruding spring tongues 5, 6 and 7 engage the collar 27. As will be explained more fully below, during this process the pressure spring 66 will be compressed between the first stop element 63 and the second stop element 25, because the distance between these stops 26 and 63 is reduced by the downward swiveling of the strap 24, as can be seen from the dotted-line representation in FIG. 3*b*. If the pegs 4 reach the bend 43 of the lever 47, then the spring tongues 5, 6 and 7 release the collar 27 by locking the latter inwards. This position is shown in FIG. 3*b*. Since the pressure spring which is not shown here is under compression, the collar 27 is pushed in the arrow direction D until the first stop 63 reaches the rail 50 as can be seen in FIG. 3*c*. In this way, the plug connector is in the locked position.

To open the plug connector, the strap 24 must first be swivelled so that a right-hand thread in the arrow direction C (cf FIG. 3*d*) can rotate the bayonet ring 2. In the process, the pegs 8 in the starting area 35 of the sliding channel 34 slide to the front face 37. The housings 3 and 23 move away from one another. The plug connector is loosened as soon as the pegs 8 have left the sliding channels 35.

FIG. 4 shows a section along the line A of the plug connector according to the invention from FIG. 3*a*, where the bayonet ring 2 has been pushed some way on the plug housing 23, but the spring tongues 5 to 7 have not yet been lifted. Starting from the left, it is possible to see outside the bayonet ring 2 with the moulded-on spring tongues 5, on which the substantially cylindrical peg 8 is moulded-on via its angled edge 16. The shoulder 17 of the bayonet ring 2 is in the guide channel 15 of the counterplug housing 3, so that the bayonet ring 2 is placed to be able to rotate about the counterplug housing 3. Behind the first guide rail 13 is the profiled gasket ring 12.

Outside on the right-hand side is shown the bayonet ring 27 with the front part 60 and the rear part 61. The collar 27 is located around the plug housing 23, so as to be able to rotate owing to the first stop 63 and the sliding shoulder 65 of the collar 27 which slide on the shell surface 53 of the plug housing 23, The rear part 61 of the collar 27, the first stop 63, the second stop 26 and the shell surface 53 enclose the spring chamber 55. FIG. 4 shows clearly that the insert 31 in the plug housing 23 is arranged against cable admission shafts 28 of the plug housing 23. In contrast with FIG. 3*a*, the section A—A of FIG. 4 passes through the centre of the strap 24 as can be seen in the lower part of FIG. 4. Starting from the front face 37 of the plug 20 can be seen the locking lug which is moulded on the terminal area 36 of the sliding channel 34. With the pressure spring 66 slack, this area (the locking lug 41 and the sliding channel 34) are overlapped by the front part of the collar 27.

Below, FIGS 5*a* to 5*d* show the combined effect of the spring tongues 5 to 7 and the locking lugs 41 and the front face 70.

FIGS. 5*a* to 5*d* show a schematic part-enlargement of the area E from FIG. 4 at various stages of the plug insertion process. For simplicity, only the spring tongue 5 with the formed-on peg 8 of the bayonet ring is shown. On the right-hand side of FIGS. 5 can be 15 seen a part of the collar 27 in the upper part and underneath a part of the plug housing 23. At the rear end of the plug housing 23 is shown a part of the circlip 25 with the second stop 26. In addition to FIG. 4, FIG. 5 shows the pressure spring 66 between the first stop 63 and the second stop 25. As can be seen in the Figures, the section passes through the locking lug 41 which is enclosed by an angled or slightly rounded ramp 20 38, a plane 39 which is parallel to the direction of plug insertion and a vertical plane 40.

Figure 5:
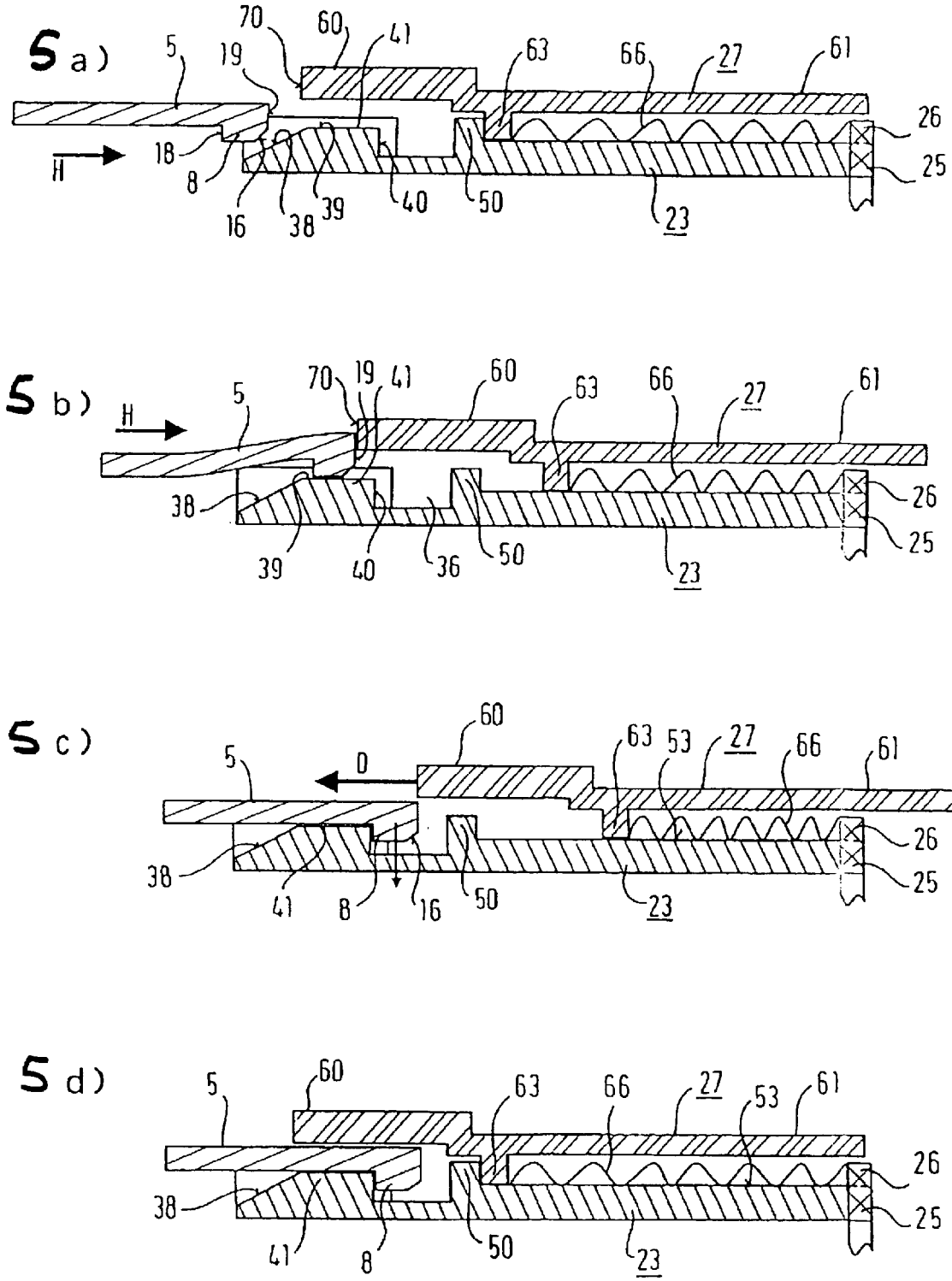

FIGS. 3 and 5 explain the manner of operation of the process of plug insertion. The fitter introduces the counterplug 1 from FIG. 1 into the plug 20 from FIG. 2, so that the 25 codings 11 and 29 grip correctly. During this process, the bayonet ring 2 reaches the plug housing 23 as seen in FIGS. 4 ad 5*a*. The pressure spring is still slack, since the distance between the first stop 63 and the second stop 26 is at its maximum.

If the bayonet ring is pushed further on the plug housing, with or without the strap 24 as shown in FIG. 3*a*, the spring tongue 5 with the moulded-on peg 8 of the bayonet ring 2 approaches the locking lug 41.

By further pushing of the bayonet ring 2, the angled edge 16 of the peg 6 reaches the ramp 38 so that the spring tongue 5 is lifted and projects above the shell surface of the bayonet ring 2. The free end 19 of the spring tongue 5 reaches against the front face 70 of the collar 27 as shown in FIGS. 3*a* and 5*d*. If the bayonet ring 2 is pushed further by spring arm 5, the collar 27 is pushed back in the arrow direction H, whereby the distance between the stop 63 and the second stop 26 is reduced. During this process, the first stop 63 moves away from the shoulder 50.

If the bayonet ring 2 is pushed further on the plug housing 23 whether by hand or via the strap 24, then the locking lug 41 is negotiated by the peg 8 so that the vertical plane 40 rests against the vertical plane 18 of the peg 8. The spring tongue 5 releases the collar 27, whereby the distance between the first stop 63 and the second stop 26 reaches its minimum, that is to say, the pressure spring 66 has maximum force at this stage (FIG. 3*b* and FIG. 5*c*). When the collar 27 is released, the spring 66 which is under compression can release its energy and push the collar 27 back in the arrow direction D, as shown in FIGS. 3*b* and 5*c*. The first stop 63 again approaches the shoulder 50, until they are again in contact. The front area of the collar 27 overlaps the spring tongue 5, so that the latter cannot jump out of its locked position (as shown in FIG. 3*c* and FIG. 5*d*). The position of the collar 27 from FIG. 5*d* corresponds to the position in 20 FIG. 5*a*, where the counterplug 1 has now been fully inserted into the plug 20 and the spring tongues 5–7 are locked in. Neither can the spring tongues 5–7 come out of their locked position owing to the front area 60 of the collar 27, nor is a rotational movement of the collar 27 possible, since the strap 24 effectively encloses the pins 4. In this way, a plug connector is obtained which is secure and unusually difficult to loosen.

It should be noted that when the fitter releases either the bayonet ring 2 or the lever 24 prematurely, that is to say, for example, in the position shown in FIGS. 3*a* and 5*b*, the collar 27 is pushed in arrow direction D by the power of the compressed spring 66 until the first stop 63 reaches the rail 50. In the process, the counterplug 1 including bayonet ring 2 is moved away from the plug housing 23. If a strap 24 is present, then this is also correspondingly swivelled, loosening the plug connector. If the plug connector is not correctly locked, the combined action of the collar, the first stop, the second stop and the spring tongue enable a direct report of the fact to the fitter.

The previously described characteristics of the embodiment examples can be combined with one another at will.

What is claimed is:

1. Electrical plug connector comprising:

a cylindrical plug;

a counterplug which is complementary to the plug; and a bayonet ring which is rotatable about a counterplug housing of the counterplug for locking the plug into the counterplug;

characterized by the fact that the bayonet ring for the locking of the plug connector in the direction of plug insertion can be pushed on a plug housing of the plug until at least one locking device of the bayonet ring interlocks with the plug housing and that the bayonet ring for the unlocking of the plug connector can be rotated about the counterplug housing, further characterized by the fact that the locking device has at least one spring tongue molded on the bayonet ring and running in the direction of the plug insertion with an inward-pointing peg and that a circumference of the plug housing has at least one sliding channel which is able to receive the peg, further characterized by the fact that a starting area of the sliding channel runs substantively at an angle to the direction of plug insertion and that a terminal area of the sliding channel runs substantively parallel to the direction of plug insertion, where the terminal area has at least one locking lug which can be negotiated by the peg, where both areas run into a front face of the plug housing.

2. Electrical plug connector with a cylindrical plug, a counterplug which is complementary to the plug, a bayonet ring which is rotatable about a counterplug housing of the counterplug for locking the plug into the counterplug, characterized by the fact that the bayonet ring for the locking of the plug connector in the direction of plug insertion can be pushed on a housing of the plug until at least one locking device of the bayonet ring interlocks with the plug housing and that the bayonet ring for the unlocking of the plug connector can be rotated about the counterplug housing, further characterized by the fact that the bayonet ring has at least one outward-pointing pin and that the plug housing has at least one lever arm which can be rotated vertically to the direction of plug insertion to grip the pin.

3. Plug connector according to claim 2 characterized by the fact that the bayonet ring has two diametrically opposite pins and that the plug housing has two diametrically opposite L-shaped lever arms which are linked together by a substantively semicylindrical C-strap.

4. Electrical plug connector with a cylindrical plug, a counterplug which is complementary to the plug, a bayonet ring which is rotatable about a counterplug housing of the counterplug for locking the plug into the counterplug, characterized by the fact that the bayonet ring for the locking of the plug connector in the direction of plug insertion can be pushed on a housing of the plug until at least one locking device of the bayonet ring interlocks with the plug housing and that the bayonet ring for the unlocking of the plug connector can be rotated about the counterplug housing, further characterized by the fact that a collar which can be pushed forwards or backwards relative to the housing in the direction of plug insertion is arranged about the plug housing.

5. Plug connector according to claim 4, characterized by the fact that a stop element is a circlip which can be fixed to the circumference of the plug housing.

6. Plug connector according to claim 4, characterized by the fact that a pressure spring rests against a first stop of the collar and against a second stop of a circlip, so that in the case of an in complete insertion of the bayonet ring, the latter is pushed back through a front face of the collar.

* * * * *